United States Patent [19]

Bentley

[11] 4,175,304

[45] Nov. 27, 1979

[54] STRAP CLOSURE

[76] Inventor: Richard P. Bentley, Box 786, Tupper Lake, N.Y. 12986

[21] Appl. No.: 968,852

[22] Filed: Dec. 12, 1978

Related U.S. Application Data

[62] Division of Ser. No. 801,330, May 27, 1977, Pat. No. 4,142,734.

[51] Int. Cl.[2] ..... A44B 11/18
[52] U.S. Cl. ..... 24/197
[58] Field of Search ..... 24/197, 193

[56] References Cited

U.S. PATENT DOCUMENTS

| | | | |
|---|---|---|---|
| 1,798,576 | 3/1931 | Alonso | 24/197 |
| 3,277,543 | 10/1966 | Gaylord | 24/193 |

*Primary Examiner*—Bernard A. Gelak

[57] ABSTRACT

A strap closure comprised of two rectangular rings held together by a common loop of strap, or other material, and a release loop attached to one of the rectangular rings. A mating strap is joined to the ring assembly by threading it through the release loop equipped ring, through and around the second ring, and back through the release loop equipped ring. The closure is opened by pulling the release loop.

1 Claim, 2 Drawing Figures

STRAP CLOSURE

This is a division of application Ser. No. 801,330, filed May 27, 1977, now U.S. Pat. No. 4,142,734.

SUMMARY OF THE INVENTION

The present invention relates to a new and useful strap closure system found to be particularly advantageous in any situation where frequent strap tightening, loosening, or opening is required. The strap closure of the present invention is also of advantage where simple one-hand operation is desirable or required.

A main object of this invention is a strap closure that holds firm under tension, yet opens easily when desired.

Another important object is a strap closure that may be tightened or loosened with a simple pull of the hand.

Further objects include a strap closure that is simple in construction, and inexpensive to manufacture.

Other features and advantages of the present invention will be apparent from the following description, taken in connection with the accompanying drawings.

DESCRIPTION OF THE PREFERRED EMBODIMENTS

The strap closure of the present invention consists of two rectangular rings 1 and 2, held together by means of a single loop of strap 3 or other material, and a release loop 4 attached to one of the rings 1. The single loop 3 holding the rings 1 and 2 together may be formed from a portion of strap at the end of a length of strap, or it may be a loop of metal or other material forming a portion of an object or structure to which strap attachment is desired.

Figure 1:
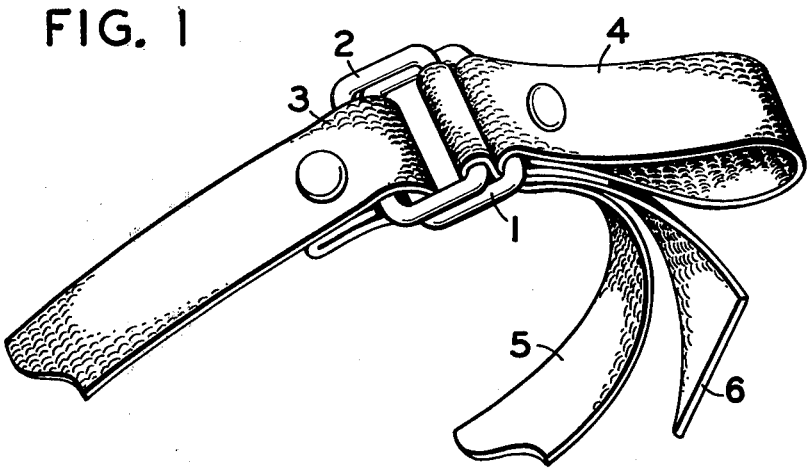
FIG. 1 is a perspective view of the strap closure.
Figure 2:
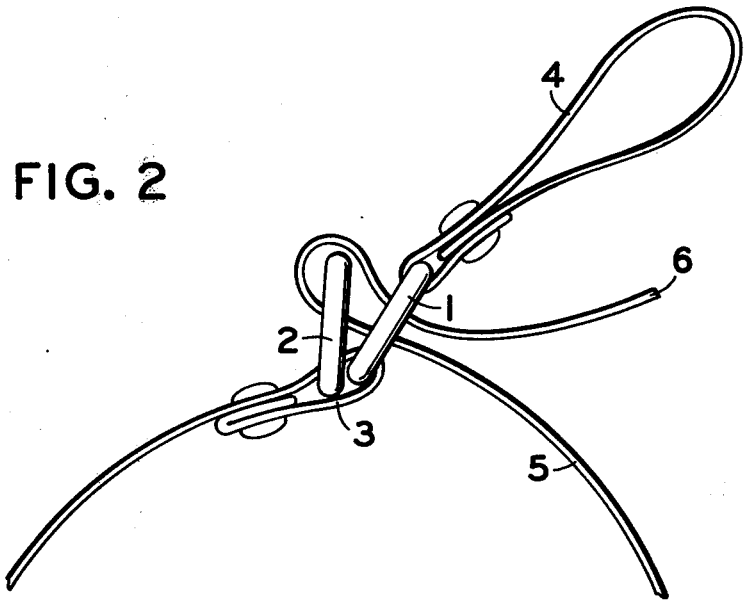
FIG. 2 is a side elevation view of the strap closure.

The release loop 4 may be of any material, and formed as a loop or a single strand, but a short loop of strap as shown in FIGS. 1 and 2 represents the preferred embodiment. The release loop 4 is attached to one of the rectangular rings 1 by means of a portion of the release loop passing around that segment of the rectangular ring 1 opposite, and parallel to, the loop 3 passing through both rings. If the release loop 4 is of a material other than a length of strap, that portion fastened around the rectangular ring 1 should have a surface friction equivalent to, or greater than, a piece of woven strap.

A mating strap 5 is joined to the strap closure of the present invention by passing the end 6 of the mating strap 5 through the release loop equipped rectangular ring 1, on through the second rectangular ring 2, around the outside of the second rectangular ring 2, and back through the release loop equipped rectangular ring 1 between the release loop 4 and the mating strap 5. This assembly is clearly shown in FIGS. 1 and 2.

The closure is easily tightened by pulling on the free end 6 of the mating strap 5. The closure is easily loosened, or opened completely, by pulling on the release loop 4 in a direction opposite to the mating strap 5.

The foregoing disclosure has described and illustrated the preferred embodiment of the present invention. Various modifications and changes may be made without departing from the scope of the appended claims.

I claim:

1. A strap closure comprising an assembly of two rectangular rings and a release loop, said rectangular rings held together by means of a single loop of strap, or other material, passing through both rings, said loop passing through both rings providing the means to attach said strap closure to a strap or other structure, and said release loop comprising a piece of strap, or other material with similar surface friction, attached to one of the rectangular rings by means of a portion of said release loop fastened around that portion of said rectangular ring opposite and parallel to said single loop passing through both rings, said closure assembly openably joined to a mating strap by means of said mating strap end being threaded through the release loop equipped rectangular ring, on through the second rectangular ring, around the outside of said second rectangular ring, and back through the release loop equipped rectangular ring between the mating strap and said release loop.

* * * * *